US006296119B1

(12) United States Patent
Wells

(10) Patent No.: US 6,296,119 B1
(45) Date of Patent: Oct. 2, 2001

(54) EXPENDABLE SHIPPING CONTAINER

(75) Inventor: David R. Wells, Plymouth, MI (US)

(73) Assignee: International Paper Company, NY (US)

( * ) Notice: Subject to any disclaimer, the term of this patent is extended or adjusted under 35 U.S.C. 154(b) by 0 days.

(21) Appl. No.: 09/515,910

(22) Filed: Feb. 29, 2000

(51) Int. Cl.[7] ..... B65D 85/52
(52) U.S. Cl. ..... 206/423; 229/120.37
(58) Field of Search ..... 206/386, 423, 206/499, 600; 47/41.01, 85; 53/467, 471, 473; 229/120.37, 120

(56) References Cited

U.S. PATENT DOCUMENTS 1,767,629 * 6/1930 Walter ..... 229/120.37
2,934,251 * 4/1960 Kramer ..... 229/120.37
3,087,666 * 4/1963 Kitchell ..... 206/423
3,185,379 * 5/1965 Kohlhaas ..... 229/120.37
3,348,667 * 10/1967 Beeby ..... 229/120.37
3,863,829 * 2/1975 Merrill ..... 206/423
4,391,371 * 7/1983 Sieffert ..... 206/600
5,141,149 * 8/1992 Fulton ..... 206/423
5,699,958 * 12/1997 Kohler ..... 229/120.37

* cited by examiner

*Primary Examiner*—Luan K. Bui
(74) *Attorney, Agent, or Firm*—Dennis H. Lambert

(57) ABSTRACT

A moisture-resistant expendable shipping container of corrugated paperboard for storing and shipping plants. The container may be stacked on top of other containers and may be palletized. It includes at least one shallow tray that forms at least a bottom for the container, and a pair of substantially identical partition members arranged in substantial mirror image relationship to one another in the tray. The partition members are formed of plural angularly interconnected flat panels resting on their edge in the tray, and define a transverse wall extending across a mid-portion of the tray and a peripheral wall extending at least partially to around the periphery of the tray. The partition members provide support for multiple containers stacked on top of one another, and at least partially enclose the plants.

11 Claims, 5 Drawing Sheets

EXPENDABLE SHIPPING CONTAINER

BACKGROUND OF THE INVENTION

1. Field of the Invention

This invention relates generally to shipping containers. More specifically, the invention relates to an expendable shipping container for shipping and storing live goods, e.g., nursery plants, shrubs and the like.

2. Prior Art

Live plants are commonly grown at nurseries and then shipped to remote destinations for sale. Current methods employed by the industry for shipping plants are cumbersome and expensive. The plants are either simply placed on the floor of an appropriate vehicle, such as a truck or trailer or other transportation media, referred to as "floor-loading", for shipment to remote destinations, or are placed in trays that are stored in re-usable metal racks placed in the vehicle.

Floor-loading of plants is time consuming, costly, and labor intensive. Moreover, this method does not utilize the height of a truck or trailer, and frequently results in damage to the plants. Also, less-than-truckload (LTL) shipments via common carriers are not feasible with this method.

The use of trays stored in re-usable metal racks enables the height of a truck or trailer to be better utilized, but this method is expensive, requiring large up-front equipment costs and substantial shipping charges for handling and returning empty metal racks to the nurseries. Moreover, the size and/or variety of sizes of plants which may be shipped via this method is severely limited by the size and shape of the racks.

Currently, there is no satisfactory expendable means of shipping goods in the nursery/plant industry, nor are there any acceptable conventional methods for less-than-truckload shipments of live nursery plants, nor is there any means available in the industry for permitting handling of the plants with hi-lo or pallet jacks, or for efficient containerized shipping of a variety of different size plants, or for shipping plants in convenient, economical, stackable, expendable containers.

Accordingly, there is need for a satisfactory expendable means of shipping goods in the nursery/plant industry, and for an economical and convenient means for less-than-truckload shipments of live nursery plants, and for permitting handling of the plants with hi-lo or pallet jacks, and for containerized shipping of a variety of different size plants, and for shipping plants in convenient, economical, stackable, expendable containers.

SUMMARY OF THE INVENTION

The present invention provides a satisfactory, low cost, expendable means of shipping goods in the nursery/plant industry. It eliminates the necessity of floor-loading plants, and provides an economical and convenient means for less-than-truckload shipments.

In accordance with the invention, a container is constructed to hold at least one live plant for convenient handling. The containers may be stacked on top of one another, and may be palletized for easy handling with suitable equipment, e.g., a hi-lo or pallet jack. Less-than-truckload shipments of plants can be conveniently and economically made using the container of the invention, and the container can be discarded after use. Depending upon the specific application, the container can be made moisture-proof.

The container is preferably made of corrugated paperboard, although it could be made of other suitable materials, such as plastic, and can be produced in various combinations of different size components which can be set up to accommodate different size plants. It is lightweight, and yet when set up has sufficient strength to be stacked to the full height of a trailer or truck, or higher in other transporting vehicles or in warehouses. The components may be shipped and stored in a compact flat condition, and may be quickly and easily set up when ready for use. Further, the container can be suitably treated to make it moisture resistant to withstand conditions encountered in the shipment and storage of live plants.

More particularly, the container of the invention comprises a shallow tray and at least one partition means resting on its side on the tray. The partition means includes a transverse wall extending across the tray, and walls or panels extending at least partially around the perimeter of the tray to at least partially enclose plants sitting in the tray. Apertures may be formed through the panels of the partition means for circulation of air around the plants.

In a preferred construction, two substantially identical partition members are arranged back-to-back in substantial mirror image relationship to one another in the tray to form the perimeter and transverse walls. In one embodiment, the transverse wall extends along the middle of the tray parallel to its length, and in another embodiment, the transverse wall extends along the middle of the tray parallel to its width.

A second tray may be inverted and placed on top of the partition means to form a cover or lid, and multiple containers, each including at least a bottom tray and a partition means, may be stacked on top of one another, with the partition means providing support for superposed containers.

In an alternative embodiment, an insert with a plurality of spaced openings therein may be placed in the tray to receive individual plants to hold them in spaced relationship to one another.

In another alternative, an insert may be placed inside the side walls in conjunction with layer pads to accommodate many layers of shorter plants within taller side walls.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
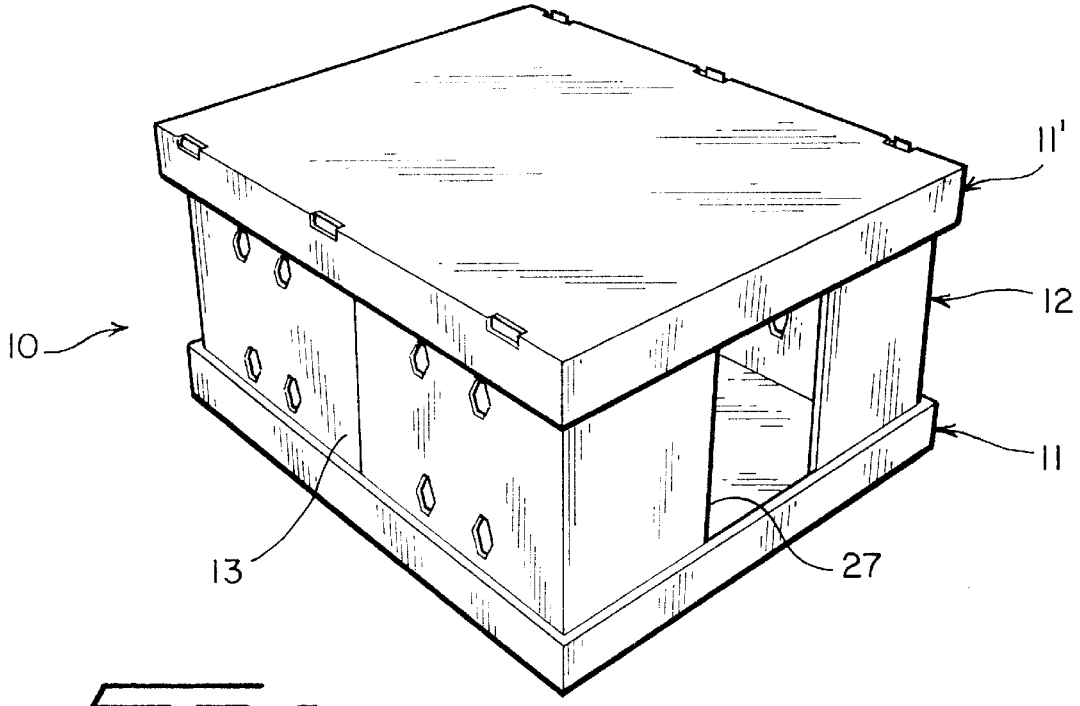
FIG. 1 is a top perspective view of a container according to a first embodiment of the invention, with a cover or lid in place.

With more specific reference to the drawings, a container according to the invention is indicated generally at 10. In a preferred embodiment, as depicted in FIGS. 1–7, the container comprises a shallow tray 11 and partition means 12 resting on its side in the tray and defining at least a partial peripheral wall 13 and a transverse wall 14. As seen in FIG. 1, a second tray 11'may be inverted and placed on top of the partition means to function as a lid or cover, although it should be understood that the container could be used without the cover, if desired.

Figure 3:
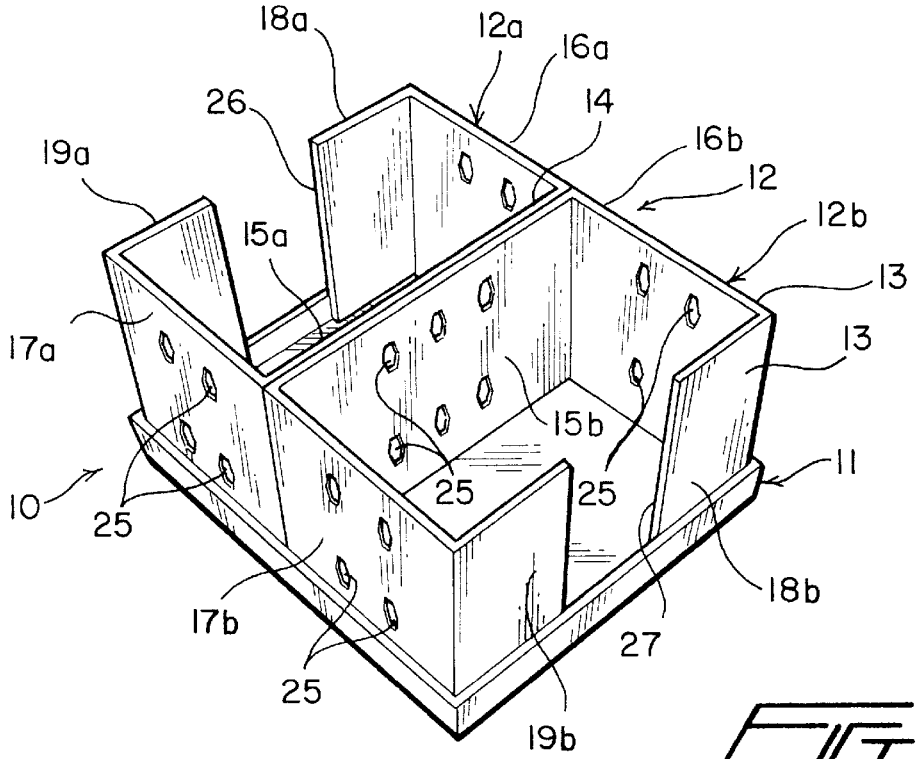
FIG. 3 is a top perspective view of a container according to the first embodiment, with the cover removed.
Figure 4:
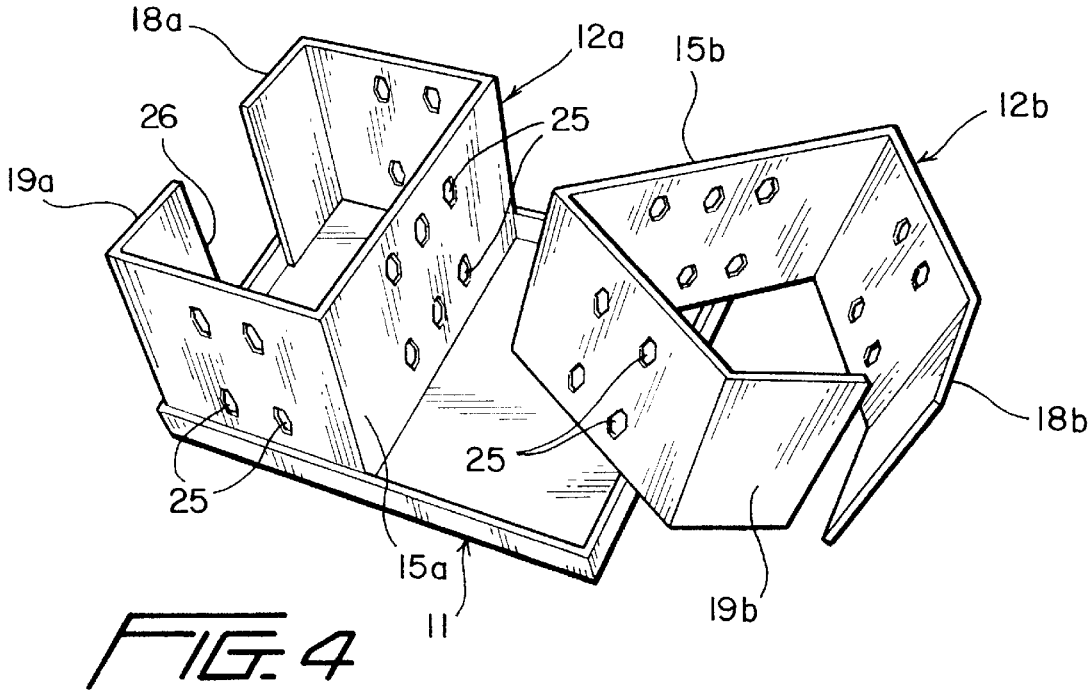
FIG. 4 is a top perspective view of the container of FIG. 3, with one of the partition members partially removed from the tray.
Figure 5:
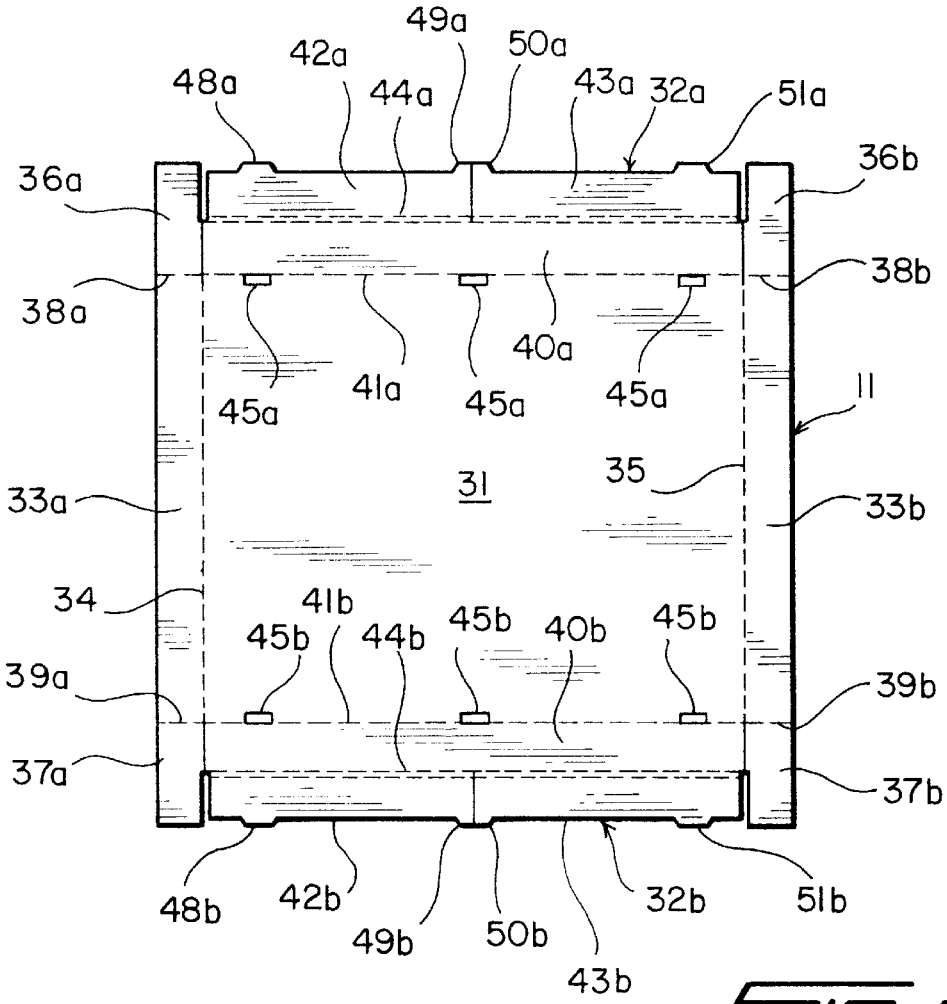
FIG. 5 is a top plan view of the blank used to make the tray used in the container of the invention.
Figure 6:
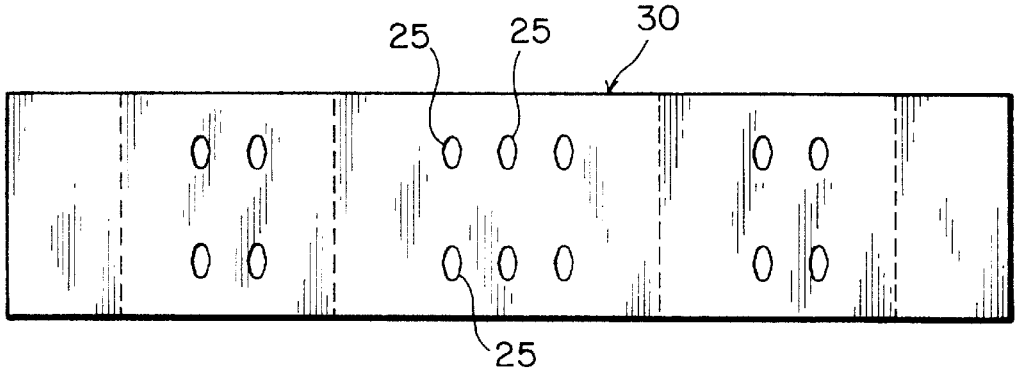
FIG. 6 is a top plan view of the blank used to make the partition member used in the container of the invention.
Figure 7:
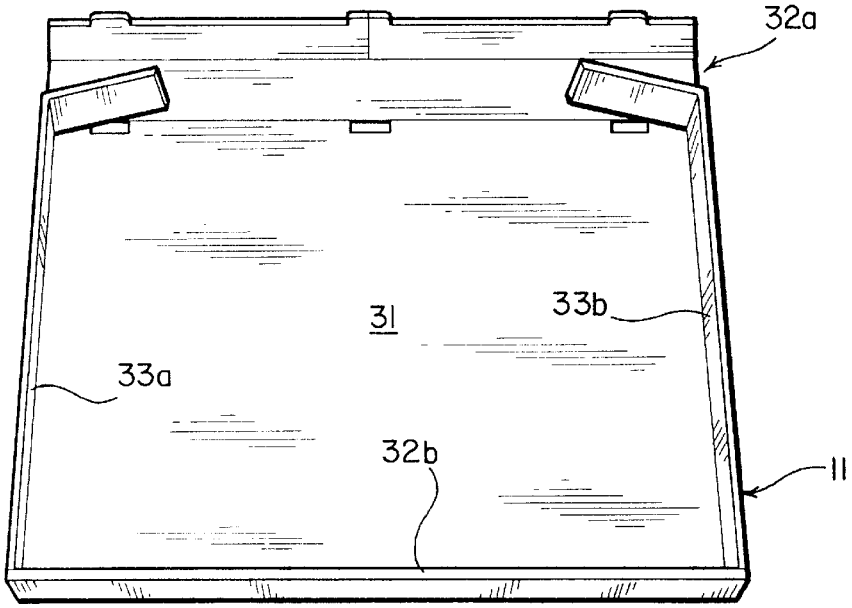
FIG. 7 is a top perspective view of a partially erected tray as used in the container of the invention.

As seen best in FIGS. 3 and 4, the partition means comprises two generally "C"-shaped partition members 12*a* and 12*b* arranged on their sides in back-to-back mirror image relationship to one another, and having first panels 15*a*, 15*b*, respectively, extending across the width of the tray at its middle and defining the transverse wall 14, second panels 16*a*, 16*b* and 17*a*, 17*b*, respectively, extending from opposite ends of the first panels toward the adjacent ends of the tray, and third panels 18*a*, 18*b* and 19*a*, 19*b*, respectively, extending partially across the opposite ends of the tray from the second panels. The second and third panels define the peripheral wall 13.

In the preferred embodiment of the invention, the first and second panels of the partition members are perforated at 25 to form vent openings for circulation of air around plants in the container. Further, the respective third panels are spaced from one another, defining large openings 26 and 27 at opposite ends of the container.

The partition members may each comprise an 1100# triple wall scored sheet (see FIG. 6) constructed of inside and outside linerboard made of Hydrokraft to ensure performance in high humidity, with the corrugations arranged to extend vertically when the partition is placed on its side in operative position in the tray.

The tray has a bottom wall 31 and upstanding side and end walls 32*a*, 32*b* and 33*a*, 33*b*, respectively. The end walls 33*a*, 33*b* comprise single panels joined to the opposite ends of the bottom wall 31 along score lines 34 and 35, respectively, and end tabs 36*a*, 37*a* and 36*b*, 37*b* are joined to the opposite ends of the respective end panels along score lines 38*a*, 39*a* and 38*b*, 39*b*, respectively. The side panels 32*a*, 32*b* comprise first panels 40*a* and 40*b* joined along score lines 41*a* and 41*b*, respectively, to opposite sides of the bottom panel, and pairs of half panel sections 42*a*, 43*a* and 42*b*, 43*b*, respectively, joined to respective first panels along double score lines 44*a* and 44*b*. A plurality of notches or slots 45*a* and 45*b* are formed in the bottom panel along opposite sides thereof closely adjacent respective fold lines 41*a* and 41*b*, with one slot on each side of the bottom panel located in alignment with the adjacent inner ends of half panels 42*a*, 43*a* and 42*b*, 43*b*, and other slots located to be in substantial alignment with opposite outer ends of the half panels. Outwardly protruding locking tabs 48*a*, 48*b*, 49*a*, 49*b*, 50*a*, 50*b* and 51*a*, 51*b* are on the outer edges of the half panels at their ends, in positions to extend into the respective slots 45*a* and 45*b* at opposite side edges of the bottom panel when the side walls are folded into their operative, erected condition.

The tray shown in the drawings and described above can be shipped in a flat knocked down condition and set up quickly and easily in the field without the need for tools. However, if desired, the tray could be of more conventional stapled construction, or pre-glued, instead of the self-locking tray described above and illustrated in the drawings.

When folding the side and end walls 32*a*, 32*b* and 33*a*, 33*b* into their erected condition, the end panels 33*a* and 33*b* are first folded upwardly, with the end tabs 36*a*, 37*a* and 36*b*, 37*b* on opposite ends of the panels 33*a* and 33*b* bent inwardly toward one another. First side wall panels 40*a* and 40*b* are then folded upwardly along the outside of the end tabs 36*a*, 37*a* and 36*b*, 37*b*, and half panel sections 42*a*, 43*a* and 42*b*, 43*b* are then folded downwardly inside of the end tabs, and the locking tabs 48*a*, 48*b*, 49*a*, 49*b*, 50*a*, 50*b* and 51*a*, 51*b* are inserted through the slots 45*a* and 45*b* to lock the side and end walls in erected position.

Figure 8:
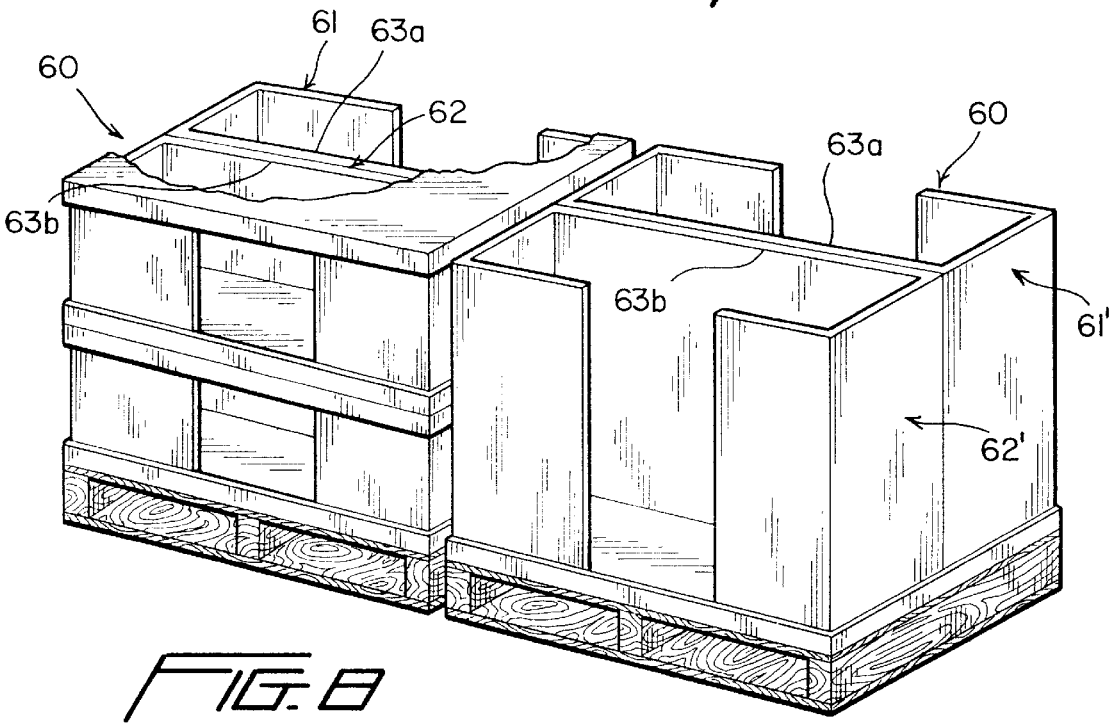
FIG. 8 is a top perspective view of a plurality of different size containers stacked on pallets, depicting how different size components may be used to produce different size containers for holding different size plants.

In an alternative embodiment, as seen in FIG. 8, the container 60 is substantially identical to that previously described and illustrated, except that the partition members 61 and 62 are arranged with their first panels 63*a* and 63*b*, respectively, extending along the longitudinal center of the tray, rather than across its width as in the FIG. 1 embodiment. Further, in the particular embodiment shown, the partition members are free of perforations, although they could be perforated as in the FIG. 1 embodiment, if desired.

Further, it will be observed in the right hand side of FIG. 8 that the partition members 61' and 62' can have a greater height to thereby increase the height of the container for accommodating plants of different size. By selecting appropriate dimensions for the partitions, they can be made in heights that are multiples of each other to facilitate stacking or bundling of the containers into a uniform shape, as illustrated in FIG. 8.

Figure 9:
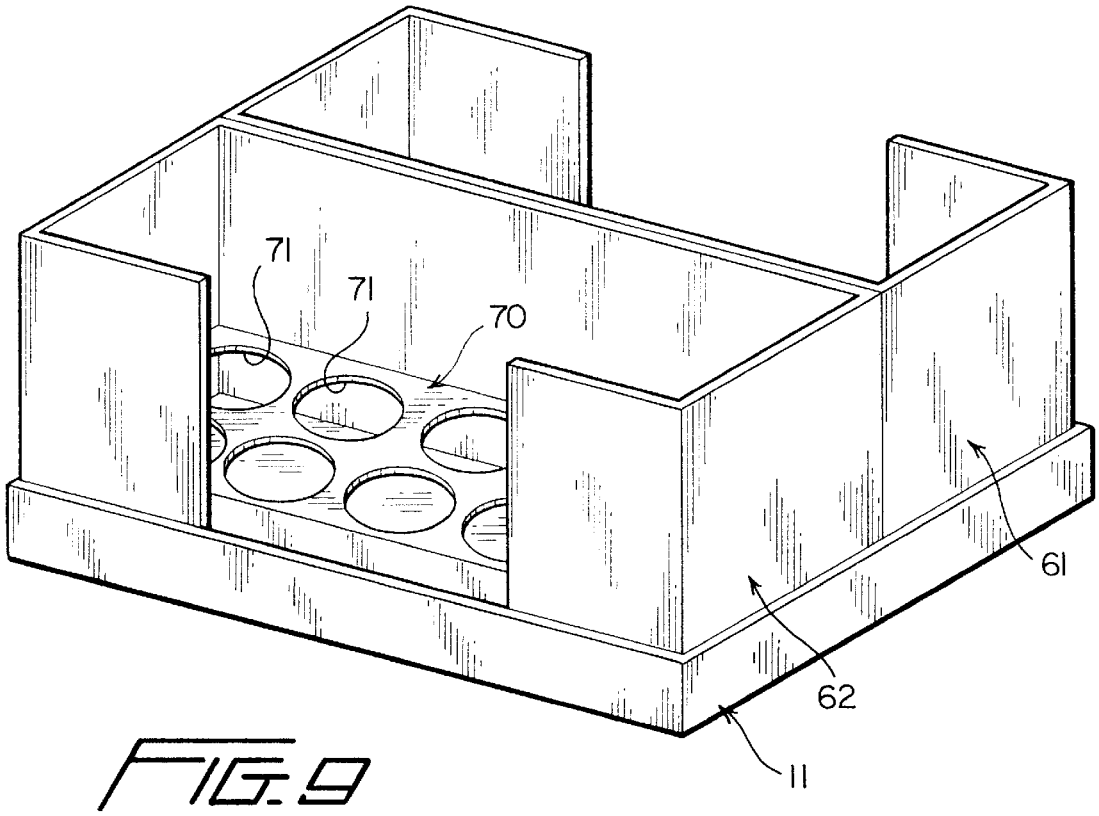
FIG. 9 is a top perspective view of a modified container according to the invention, wherein an insert is placed in the tray to receive and hold individual plants in spaced relationship to one another.
Figure 10:
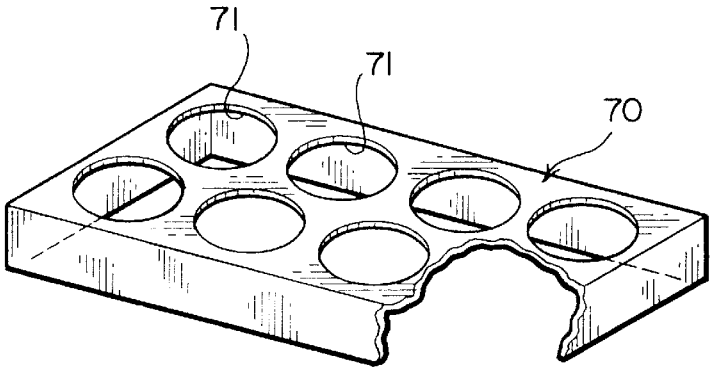
FIG. 10 is a top perspective view, with portions broken away, of the insert used in FIG. 9.

A further embodiment of the invention is shown in FIGS. 9 and 10, where an insert 70 is placed in the container. The insert has a plurality of openings 71 formed therein to receive individual plants and keep them uniformly spaced from one another. Since the insert can simply be placed in and removed from the container, it can be used or not, as desired, thereby lending great versatility to the container of the invention.

By mixing and matching the various components, including partitions of different size, a variety of different size and shape containers can be made from an inventory of relatively few standardized parts. Further, all of the components can be stored and shipped in compact, flat condition, and quickly and easily erected at the point of use.

Figure 2:
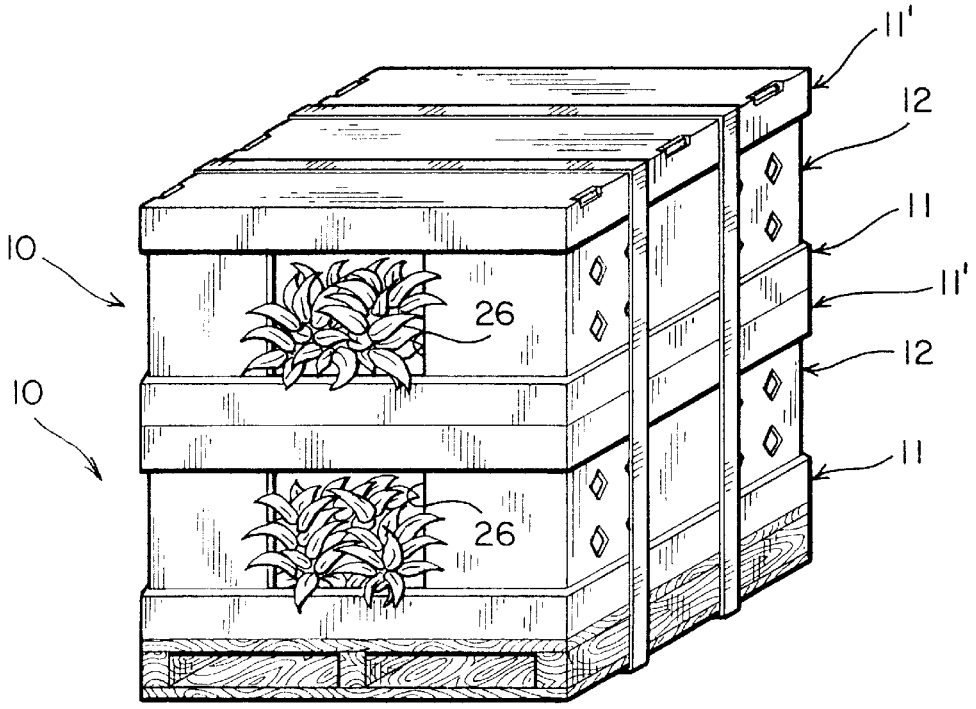
FIG. 2 is a top perspective view of a plurality of containers according to the invention stacked on top of one another and strapped to a pallet.

As seen in FIGS. 2 and 8, the container of the invention may be stacked, whereby the full height of a vehicle can be utilized. Moreover, the container may be palletized for convenient handling by mechanized equipment. These features facilitate the handling and storage of nursery plants, and minimize damage to the plants that may be caused by repeated handling that is likely to occur during shipment and storage. The container of the invention makes it possible to economically transport less than truckload shipments, and because of the light weight and disposability of the container, greatly reduces the cost of shipments of live nursery plants.

The tray may be coated with a material to make it moisture resistant. A suitable material is available through International Paper Company under the name Fibreshield®.

While particular embodiments of the invention have been illustrated and described in detail herein, it should be understood that various changes and modifications may be made to the invention without departing from the spirit and intent of the invention as defined by the scope of the appended claims.

What is claimed is:

1. An inexpensive, lightweight, expendable shipping container for shipping, storing and palletized handling of live nursery plants of various sizes, wherein the container may be shipped in a flattened condition and erected at the point of use, comprising:

a shallow tray having a bottom wall and upstanding low side walls, said tray defining a bottom for the container; and a pair of substantially identical partition members resting unsecured in the tray in mirror image relationship to one another, each partition member comprising a plurality of foldably connected flat panels resting on a side edge thereof on the tray and held in folded relationship by the tray, said panels of each partition member including an elongate back panel with opposite ends, an end panel extending perpendicularly from each of the respective opposite ends of the back panel, and a return panel extending perpendicularly from each end panel toward a corresponding return panel at the opposite side of said partition member, the back panels of the partition members being arranged in back-to-back, parallel, contiguous relationship to one another, with the end panels of one partition member extending parallel to but in an opposite direction from the end panels of the other partition member, and the return panels of each partition member extending toward one another and terminating at respective free ends in spaced apart relationship, said panels defining a partial peripheral side wall for the container and a transverse wall extending across a midportion of the container, said partition members partially enclosing and protecting plants held therein and providing support to multiple containers stacked on top of one another.

2. An expendable shipping container for live plants as claimed in claim 1, wherein:

the partition members are perforated to permit circulation of air about the plants held therein.

3. An expendable shipping container for live plants as claimed in claim 2, wherein:

a second tray is inverted and placed on top of the partition members to function as a cover.

4. An expendable shipping container for live plants as claimed in claim 3, wherein:

an insert with a plurality of spaced openings therein is placed in the tray to receive individual plants to hold them in spaced relationship to one another.

5. An expendable shipping container for live plants as claimed in claim 4, wherein:

different partition members of different height are provided for interchangeable substitution in the tray to form containers of different height for accommodating plants of different height.

6. An expendable shipping container for live plants as claimed in claim 5, wherein:

the different heights are multiples of a first height, whereby a pair of stacked containers each having partition members of a first height have a combined height equal to the height of a single container having partitions of a second height therein.

7. An expendable shipping container for live plants as claimed in claim 1, wherein:

different partition members of different height are provided for interchangeable substitution in the tray to form containers of different height for accommodating plants of different height.

8. An expendable shipping container for live plants as claimed in claim 7, wherein:

the different heights are multiples of a first height, whereby a pair of stacked containers each having partition members of a first height have a combined height equal to the height of a single container having partitions of a second height therein.

9. An expendable shipping container for live plants as claimed in claim 1, wherein:

the tray and partition members are made of corrugated paperboard.

10. An expendable shipping container for live plants as claimed in claim 8, wherein:

the tray and partition members are made of corrugated paperboard.

11. A knocked-down, flattened shipping container for live plants, comprising:

a first flat blank of corrugated paperboard scored to form a rectangular bottom panel and four narrow sidewall panels foldably joined to respective opposite edges of the bottom panel, said sidewall panels being foldable into erected positions perpendicular to the bottom panel to form a shallow rectangular tray; and second and third substantially identical flat blanks of corrugated paperboard each scored to form a partition member for placement in the tray of an erected container, each blank having a flat rectangular back panel with opposite ends, a flat rectangular end panel foldably joined to each of the opposite ends of the back panel, and a flat rectangular return panel foldably joined to each end panel, said partition members being shippable in a flat condition and easily erected at a point of use by folding the panels so that the end panels extend perpendicularly to the respective back panels and the return panels extend parallel to the respective back panels, whereby the partition members are generally C-shaped and can be placed in back-to-back mirror image relationship in an erected tray to form a peripheral wall at least partially enclosing plants in the tray.

* * * * *